United States Patent [19]

Main

[11] Patent Number: 4,530,231

[45] Date of Patent: Jul. 23, 1985

[54] METHOD AND APPARATUS FOR EXPANDING TUBULAR MEMBERS

[75] Inventor: Perry A. Main, Erie, Mich.

[73] Assignee: APX Group Inc., Toledo, Ohio

[21] Appl. No.: 165,731

[22] Filed: Jul. 3, 1980

[51] Int. Cl.[3] ..... B21D 41/02

[52] U.S. Cl. ..... 72/393; 72/36

[58] Field of Search ..... 72/36, 393; 92/13.4, 92/13.41, 13.5

[56] References Cited

U.S. PATENT DOCUMENTS

| | | | |
|---|---|---|---|
| 2,713,279 | 7/1955 | Harris | 72/36 |
| 3,385,087 | 5/1968 | Huth | 72/393 |
| 3,986,383 | 10/1976 | Petteys | 72/393 |

*Primary Examiner*—Lowell A. Larson

*Attorney, Agent, or Firm*—Anthony J. Casella; Gerald E. Hespos

[57] ABSTRACT

The disclosure embraces a method of and apparatus for expanding circular cylindrical metal tubing, pipe or tubular members wherein an expanding construction embodies expandable fingers or members and cone-shaped means cooperating with the fingers or members for expanding tubing, pipe or tubular members. The method and apparatus involves the use of power means for expanding the fingers by relative movement of cones engaging the fingers, the method and apparatus including selectable indexing means for determining the amount of expansion of tubing, pipe or tubular members.

10 Claims, 9 Drawing Figures

METHOD AND APPARATUS FOR EXPANDING TUBULAR MEMBERS

TECHNICAL FIELD

This invention relates to a method of and means for expanding tubular members or tubing as, for example, metal tubing, where it is desired to expand an end region of one tube to telescopingly receive an end region of another tube of substantially the same normal size or for resizing or straightening end regions of tubing.

BACKGROUND ART

Endeavors have been made to manually expand an end region of metal tubing but such efforts have not been entirely satisfactory. Such devices comprise manually operated screw threaded means in which a plurality of expanding fingers are engaged by two cones, one of which is mounted on a shaft, and the opposite end of the shaft threaded to receive a nut. In using such a device the operator telescopes an end region of a tube to be expanded onto the fingers and applies a wrench to the nut on the shaft to draw the cones toward one another and thereby expand the fingers.

The cone adjacent the open end of the tube moves the fingers outwardly more easily than the other cone so that when the nut is drawn up it is found that the end region of the tube is usually expanded a greater amount than the region of the tube adjacent the opposite cone so that the expanded portion is tapered and not circular cylindrical. Even with the use of substantial manual pressure, the expanded portion of the tube is of slightly tapered character with the larger diameter of the expansion at the open end of the tube. Furthermore in the use of such device there is no indexing means for determining the extent of movement of the cones in expanding a tube so that it is extremely difficult to duplicate the same amount of expansion of a succeeding tube or tubes.

DISCLOSURE OF THE INVENTION

The present invention relates to a method of and apparatus for expanding circular cylindrical tubing, pipe or tubular members and more especially a method and apparatus for expanding an end region of a metal tube while maintaining a circular cylindrical tube configuration whereby the expanded region telescopingly receives the end region of a normal tube of substantially the same size.

The invention has for a main object the provision of power operated means for expanding a group of fingers to expand tubing wherein a lengthwise movable means for expanding the fingers is of a constant stroke so that tubes of the same size may have their end regions successively expanded whereby the amount of expansion of each tube is the same.

The invention embraces a hollow cylindrical indexing member or barrel in which is slidably disposed a selector or locator means or member adjustable to particular indexing positions, the relative position of the selector or locator member determining the amount of expansion of the fingers for expanding an end region of a tube or tubing.

The hollow tubular indexing member has slots of different depths for positioning the selector or locator in several positions, the positions of the selector determining the amount of expansion of the expanding fingers whereby the same degree of expansion is attained on successive tubes of the same size subjected to the expanding fingers.

The apparatus or device is usable with more than one group of expanding fingers to provide successful expansion of various diameters of tubes. By selecting a group of fingers for expanding tubes of a particular size range, the expansion of fingers in expanding or enlarging an end region of tube maintains the region of expansion of the tubing in substantially a circular cylindrical shape without flat spots occurring in the tubing between adjacent expanded fingers.

The invention is inclusive of power means of a character providing for substantial expansive pressures of two thousand pounds or more per square inch to assure that the expanding fingers are forced outwardly to positions during an expansion movement to provide a substantially circular cylindrical expanded region of a tube or tubing.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawings.

BRIEF DESCRIPTION OF THE DRAWINGS

The details of my invention will be described in connection with the accompanying drawings, in which.

BEST MODE FOR CARRYING OUT THE INVENTION

The method of the invention and the apparatus for carrying out the method are particularly for use in expanding end regions of circular cylindrical metal tubing for accommodating or receiving an end region of tubing of substantially the same normal diameter or size. The invention has particular utility in processing an end region of a metal tube to telescopingly receive an end region of another tube, especially for connecting tubes used for conveying gases of an exhaust gas system employed with an internal combustion engine of an automotive vehicle.

The invention embodies power driven means for expanding a group of fingers to enlarge an end region of a metal tube or tubing, the apparatus and arrangement including selective indexing means for predetermining the amount of expansion of tubing or tubular members of various diameters and whereby successive tubes of the same diameters may be expanded the same amount without adjustments of any components.

Figure 1:
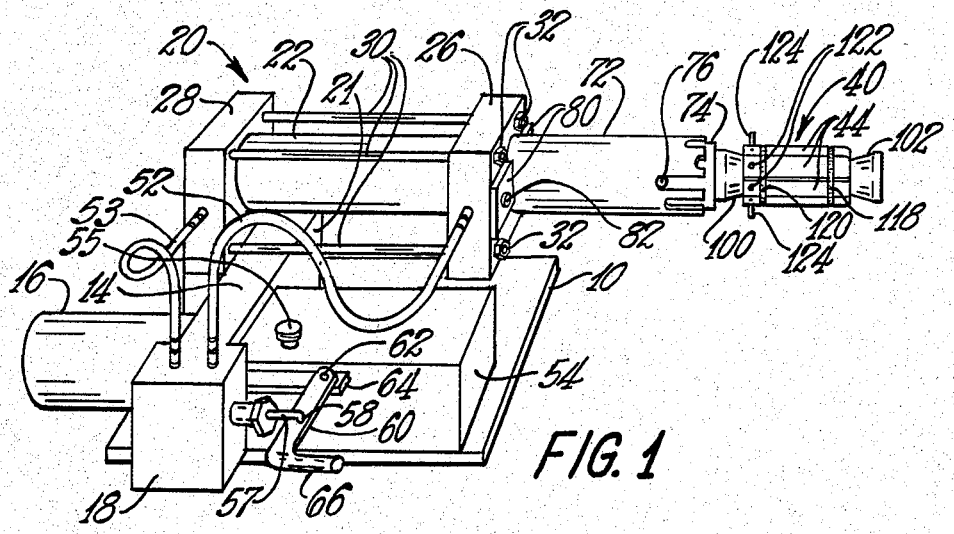
FIG. 1 is an isometric view of one form of apparatus for carrying out the method of expanding regions of circular cylindrical metal tubing.

Referring to the drawings in detail, FIG. 1 illustrates a form of apparatus or arrangement for carrying out the method of the invention, the arrangement disclosed being particularly usable for expanding end regions of metal tubing for exhaust gas conveying systems or the like to telescopingly receive other tubes or tubing in joining tubes together.

Figure 8:
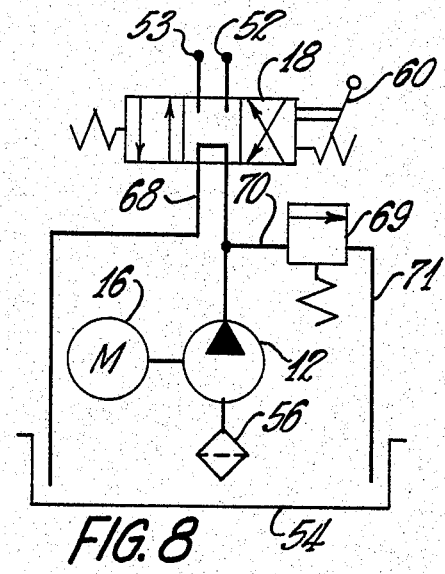
FIG. 8 is a schematic view of the hydraulic circuit for actuating the tube expanding means.

The arrangement or apparatus is mounted on a base plate or member 10 on which is supported a rotary hydraulic or fluid pump 12 shown schematically in FIG. 8 the hydraulic pump 12 being enclosed within a housing or casing 14, the latter being shown in FIG. 1.

Figure 9:
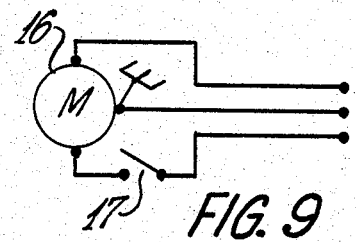
FIG. 9 is a schematic view of the electrical diagram for the motor circuit driving the rotary hydraulic pump for generating hydraulic pressure for actuating the tube expanding means.

Secured to the housing 14, which encloses the rotary hydraulic pump 12, is an electric motor 16, the electric motor 16 being arranged to drive the rotary hydraulic pump 12. The electric motor 16 is provided with a switch 17, shown schematically in FIG. 9, for controlling the motor.

The housing 14 has a forwardly extending housing component 18 the housing portion 18 enclosing conventional valve mechanism for controlling fluid flow to a piston-type hydraulic motor 20. The hydraulic pump housing 14 has a lateral extension 21, shown in FIG. 1, upon which is mounted a piston-type hydraulic motor 20. The piston-type hydraulic motor 20 includes end heads 26 and 28 which are secured to the ends of the cylinder 22 by means of long bolts or rods 30 equipped with nuts 32. The end head 28 is secured to the extension 21. Slidably disposed within the cylinder 22 is a piston 34 mounted on a piston rod 36.

The apparatus includes a tube expanding arrangement or assembly 40 having an assemblage of expandable fingers or members 44, and the movement of the piston 34 is effective to move fingers 44 outwardly to expand an end region of a metal tube telescoped onto the fingers 44 as hereinafter described.

Figure 2:
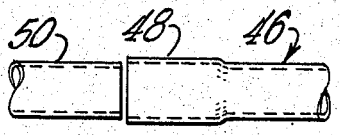
FIG. 2 is a fragmentary view illustrating a tube with an expanded end region adapted to receive an end region of a tube of the same normal diameter.

FIG. 2 illustrates a metal tube or tubing 46 having an enlarged expanded end region 48, the region 48 being expanded by outward movement of the fingers 44 under hydraulic pressure exerted against the piston 34. The region 48 of the tube 46 is expanded to an extent whereby a tube 50 of substantially the same normal diameter as the tube 46 is telescopingly slidably and snugly received within the expanded region 48 of the tube 46. The tubes 46 and 50 may be an exhaust pipe and a tail pipe of an automotive exhaust gas conveying system.

The cylinder end head 26 is connected by means of a tubular member 52 with the control valve housing 18, and the cylinder end head 28 is connected with the valve housing 18 by means of a tubular member 53. A fluid reservoir 54 provided with a filler cap 55 is secured to the hydraulic pump housing 14, the reservoir 54 containing oil or other fluid for actuating the piston 34. Disposed in the reservoir 54 is a conventional oil filter 56, shown schematically in FIG. 8, which filters the oil admitted to the hydraulic pump 12.

The flow of hydraulic fluid from the hydraulic pump 12 to the cylinder heads is controlled by valve mechanism of conventional construction in the housing 18 actuated by a control rod 57 which extends into the valve casing or housing 18. The rod 57 is connected by means of a pivot pin 58 with a control member 60 which is pivotally supported by a pin 62 carried by an extending portion 64 of the valve housing 18.

The control member 60 is provided with a manipulating handle 66. With reference to FIG. 1, when the control member 60 is in an intermediate or neutral position and the rotary hydraulic pump 12 is operating, the fluid flow from the hydraulic pump 12 is conveyed through a pipe 68, shown schematically in FIG. 8, into the reservoir 54.

When the control member 60 is moved in a right-hand direction, as viewed in FIG. 1, the valve rod 57 moves the valve mechanism in the housing 18 to direct fluid from the pump 12 through the tubular member 52 into the head 26, the fluid exerting pressure against the piston 34 to move the piston in a left-hand direction, as viewed in FIGS. 1 and 4, causing expansion of the tube expanding fingers 44 as hereinafter more fully described.

When the control member 60 is moved in a left-hand direction, as viewed in FIG. 1, it moves the valve rod 57 in a left-hand direction and shifts the valve mechanism in the housing 18 to direct fluid from the pump 12 through the tube 53 into the end head 28 and against the piston 34 to move the piston in a right-hand direction thereby effecting a contraction of the fingers 44 to release the enlarged expanded region of the tube from the expanding means 40 as hereinafter explained in detail.

Means is provided for bypassing the fluid or oil into the reservoir 54 when the piston reaches either end of its stroke and the fluid pressure pump 12 is still operating. As shown schematically in FIG. 8, the fluid circuit is provided with a spring biased relief valve 69 of conventional construction in a bypass 70 for permitting return of fluid to the reservoir 54 through a pipe 71 when the fluid pressure builds up sufficiently to release the relief valve 69.

In this manner the relief valve 69 may be adjusted so that when the fluid pressure in the system reaches about two thousand pounds or more per square inch, the relief valve 69 will be opened and the oil or fluid diverted through the pipe 71 into the reservoir 54 so that even though the hydraulic pump 12 is still operating the fluid or oil from the pump 12 will be diverted into the reservoir 54 to prevent damage to components of the system.

The apparatus or arrangement associated with the piston for actuating or controlling the expandable fingers 44 includes a circular cylindrically-shaped tubular member, element or barrel 72 having a group or groups of slots or recesses of different lengths, which group or groups of slots provide indexing means for determining the amount of expansion of the expanding fingers 44 whereby tubes of different internal diameters may be expanded a predetermined amount.

Figure 7:
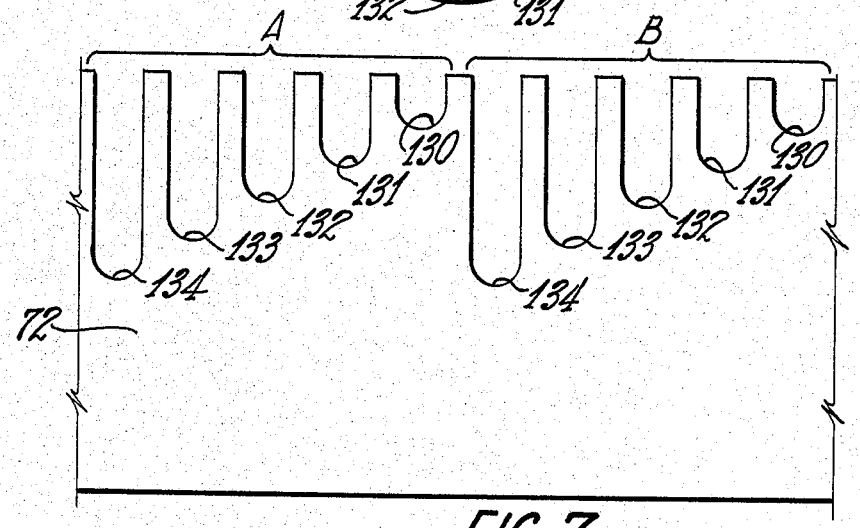
FIG. 7 is an expanded planar view of the tubular means having the indexing slots for positioning the selector.

Associated with the barrel-like member or element 72 is a slidably adjustable selector, selector element or locator 74 having pins or abutments 76 which bottom in any one of the pairs of slots in the barrel 72, the latter being shown in expanded position in FIG. 7 to illustrate the groups of slots of various depths. The selector element 74 is slidable within the indexing member or barrel 72 so that the pins or abutments 76 may be engaged with any of the pairs of slots particularly shown in FIG. 7.

Figure 6:
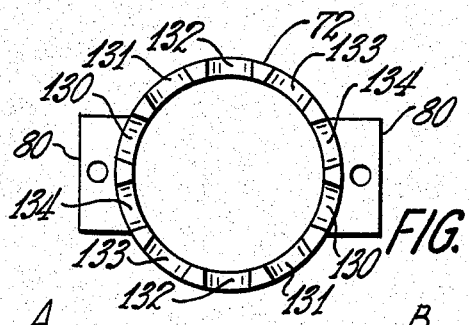
FIG. 6 is an end view of tubular means having indexing slots accommodating a slidably adjustable selector or locator for controlling the tube expanding means.

The slotted end of the barrel 72 is shown in FIG. 6. An end region of the tubular indexing element or barrel 72 adjacent the cylinder end head 26 of the piston-type hydraulic motor 20 is provided with laterally extending portions or lugs 80 which are drilled to accommodate threaded members or cap screws 82 extending into threaded bores in the end head 26 whereby the indexing barrel or member 72 is fixedly secured to the end head 26.

Figure 3:
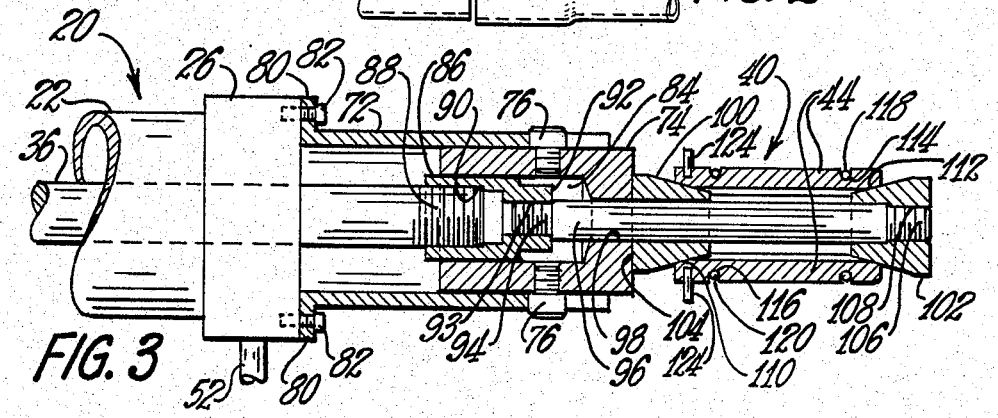
FIG. 3 is a partial sectional view illustrating a portion of the apparatus shown in FIG. 1.

The adjustable slidable indexing selector element or locator 74 is provided with a central bore 84 which slidably accommodates a coupling member 86 particularly shown in FIG. 3. As shown in FIG. 3, the end of the piston rod 36 is threaded as at 88, the threads extending into a threaded bore 90 in the coupling member.

The coupling member is provided with an extension or portion 92 having an interiorly threaded bore 93 into which extends a threaded end 94 of a shaft or rod 96. The shaft or rod 96 is slidable in a bore 98 provided in an end wall of the slidably adjustable selector 74.

The expanding means for engaging the expandable fingers or members 44 is inclusive of two cones 100 and 102. The cone 100 is provided with a bore slidably accommodating the shaft or rod 96, the surface 104 at the large end of the cone 100 abutting against the outer end surface of the adjustable selector member 74 as shown:in FIGS. 1, 3 and 4. The cone 100 may be an integral projection on the selector 74. The outer end of the shaft or rod 96 is threaded as at 106 and the cone 102 is provided with a threaded bore 108, the cone 102 being threaded onto the end of the shaft 96. The cone 102 may be an integral part of the shaft 96.

Each of the fingers 44 is provided at one end adjacent the cone 100 with a tapered surface 110 which engages the surface of the cone 100, and the opposite end of each of the fingers 44 is provided with a tapered surface 112 which engages the surface of the cone 102. The outer surfaces of the fingers of the group are provided with grooves 114 and 116.

The grooves 114 accommodate a contractile coil spring 118, and the grooves 116 accommodate a contractile coil spring 120. The contractile coil springs 118 and 120 exert sufficient pressure to hold all of the fingers 44 in constant engagement with the tapered regions of the cones 100 and 102.

The tapered regions 110 and 112 of the fingers collectively form cone-shaped openings for engagement with the tapered surfaces of the cones 100 and 102 whereby relative movement of the cones inwardly of the group of fingers 44 causes the fingers to move outwardly or expand. The exterior expanded diameter formed collectively by the fingers is of circular cylindrical character whereby the region of the tube on the fingers is expanded to a substantially circular cylindrical configuration as shown at 48 in FIG. 2.

The fingers 44 are provided at the end regions adjacent the cone 100 with circular openings 122 shown in FIG. 1, and two of the openings 122 in the fingers receive abutment means or pins 124. The abutments or pins 124 are engaged by the end of a tube telescoped over the fingers 44 to properly position the tube during the expanding movement of the fingers to form the expanded region of the tube such as shown at 48 in FIG. 2.

Figure 4:
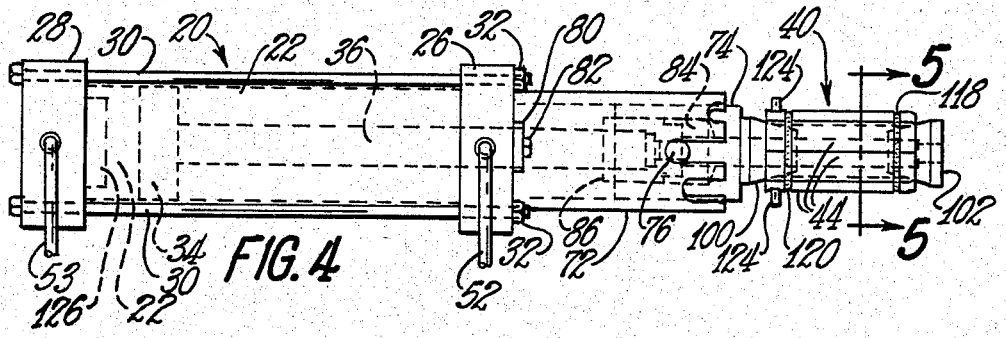
FIG. 4 is a side elevational view of the hydraulic piston-type motor and associated mechanism of the tube expanding means.
Figure 5:
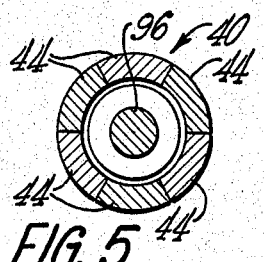
FIG. 5 is a detailed sectional view taken substantially on the line 5—5 FIG. 4.

During an expansion cycle of the apparatus, the piston 34 in the cylinder 22 is limited in its left-hand movement, as viewed in FIG. 4, by an abutment 126 on the cylinder end head 28. Through this arrangement, during movement of the piston to expand the fingers 44, the piston 34 engages the abutment 126 and thereby limits the amount of expansion of the fingers 44.

The fixed sleeve or barrel-like indexing member 72 is provided with a group or groups of slots or recesses of various depths, the end surfaces of a pair of selected slots of the same depth being engaged by the pins or abutments 76 on the locator or selector member 74. The depth of the selected slot or pair of slots determines the amount of relative movement of the cones 100 and 102 toward one another in expanding the fingers 44.

Referring particularly to FIG. 7, preferably two groups of slots or recesses, namely groups A and B, are formed in a wall at the outer end region of the tubular or barrel-like indexing element 72. In the embodiment illustrated, there are five open-ended slots of different lengths in each of groups A and B and are identified by numerals 130, 131, 132, 133 and 134.

The slots in the indexing or barrel-like member 72 are of widths to slidably receive the abutments or pins 76 on the selector or locator member 74 shown particularly in FIGS. 3 and 4. The slots of each group are of varying depths and the corresponding slots of each group are of the same depth.

The selector or locator member 74 may be manually rotated to position the selector or locator 74 in any of the several positions, the depth of the slot or pair of slots engaged by the pins or abutments 76 determining the amount of expansion of the fingers 44, the maximum expansion of the fingers being determined when the piston 34 of the hydraulic motor 24 engages the abutment 126 on the cylinder head 28.

As previously mentioned herein it is desirable to utilize, for example, one of two or more groups 40 of fingers 44 in association with cones 100 and 102. The different groups of fingers 44 are of unexpanded minimum diameters or sizes and a selected group of fingers may be used for a different range of the indexing slots 130 through 134.

For example, assume that the slots 130, 131 and 132 are for expanding tubes of normal range of diameter from $1\frac{7}{8}$ inches to $2\frac{1}{8}$ inches, an expander 40 with a set of fingers 44 will have a diameter to be received within a tube of $1\frac{3}{4}$ inches to about $2\frac{1}{8}$ inches.

In expanding tubes of these sizes the proper pair of slots 130, 131 and 132 is selected for expanding a tube in the desired range. A set of fingers 44 is selected of normal unexpanded diameter to be received in the end of a tube ranging between $1\frac{3}{4}$ inches to $2\frac{1}{8}$ inches so that the expansion of the tube would come out to about $1\frac{1}{8}$ of an inch increase in diameter of the expanded region of the tube.

The group of fingers 44 of an expander 40 is selected whereby the fingers may be expanded without the fingers 44 spreading sufficiently during expansion to cause flat spots in the expanded region of the tube or tubing.

If a tube of a larger diameter is to be expanded then the selector or locator 74 may be adjusted so that pins or abutments 76 engage in the slots 133 or 134. In this event a group of fingers 44 of larger initial diameter would be used in association with the cones 100 and 102 so that a tube of larger diameter, for example, $2\frac{1}{4}$ inches may be expanded to a diameter of $1\frac{3}{8}$ inches without any appreciable flat spots forming in the tube between adjacent expanded fingers.

It is therefore apparent that selected slots of the groups of slots A and B for various ranges of tube size may be used with particular sets of fingers of different initial diameters to secure expansion of tubes or tubing of a substantial range of diameters without flat spots occurring in the tubing so that the expanded region of the tube irrespective of size is maintained of a substantially circular cylindrical shape.

With this method and arrangement, most thin-walled metal tubes of sizes from about $1\frac{3}{4}$ inches inside diameter to $2\frac{1}{2}$ inches inside diameter or more may be expanded through the selection of a group of fingers 44 having one minimum diameter or a group of fingers 44 of a larger minimum diameter to expand tubes in this size range without appreciable flat spots being formed in the expanded region of the tube due to the separation of the fingers as they are expanded outwardly.

It is to be understood that one group of slots A may be used with one abutment pin 76 in a selector 74 without the use of a second group of slots in the barrel member 72 and without the second abutment pin or member 76. The indexing slots in the barrel or tubular indexing member 72 may be varied in depth to accommodate different ranges of sizes of tubing to be expanded and that more than two groups of fingers 44 may be used of different minimal diameters to accommodate expansion of the tubes in various size ranges without the formation of appreciable flat spots on the expanded region of tubing.

When the selector or locator 74 is positioned with the pins 76 in one of the pairs of slots in the indexing barrel or member 72, tubing or tubes of the same size may be successively expanded without any adjustments of any kind being made because the stroke of the piston 34 which controls the movement of the cone 102 is always the same so that the expansion of successive tubes will be the same.

The operation of the apparatus in expanding an end region of a metal tube or tubing is as follows: The operator mounts the group of fingers 44 on the cones 100 and 102, the minimum diameter of the group of fingers selected being compatible with the diameter of the tube or tubing to be telescoped over the fingers prior to an expanding operation.

The minimum diameter of the group of fingers selected by the operator for expanding a tube should approach the normal inside diameter of the tube so that the end region of the tube may be expanded to a desired size but without forming flat spots on the expanded region of the tube. The operator selects the pair of slots in the indexing barrel or member 72 to secure the desired degree of expansion of the tube with a minimum stroke of the piston and hence a minimum outward movement of the fingers 44 relative to the cones 100 and 102.

The operator adjusts or positions the selector or locator 74 with the pins 76 engageable in the pair of selected slots depending upon the amount or degree of expansion to be made on the end region of a tube or tubing. As shown in FIGS. 1, 3 and 4 the left-hand cone 100 is in abutting or engaging relation with the end surface of the selector or locator 74. During movement of the piston 34 the cone 100 remains stationary.

The relative position of the selector 74 with respect to the slots in the indexing barrel or member 72 determines the amount of expansion of the fingers because the stroke of the piston 34 in expanding the fingers is constant. Hence the amount of expansion of the fingers 44 is governed by the relative selected position of the selector or locator 74.

The operator telescopes the end region of a tube or tubing to be expanded onto the fingers 44 with the end of the tube or tubing engaging the abutment pins 124. The electric motor 16 is energized by closing the switch 17, shown in FIG. 9, to initiate operation or rotation of the hydraulic pump 12 for building up fluid or oil pressure for actuating the piston 34 in the cylinder 22.

When the pump motor 16 is energized, the control lever 66 is in a mid or neutral position whereby oil pumped into the circuit by the hydraulic pump 12 is bypassed into the reservoir through the pipe 68.

With the tube or tubing to be expanded in engagement with the pins 124, the operator moves the handle 66 of the control member 60 in a right-hand direction, as viewed in FIG. 1, actuating the valve rod 57 which moves the valve means, shown schematically in FIG. 8, in the housing 18 to a position to effect flow of oil or fluid from the pump 12 through the tube 52 and end head 26 into the cylinder 22 at the right-hand side of the piston 34.

The rotation of the hydraulic pump 12 builds up hydraulic pressure on the right-hand side of the piston 34 causing the piston to move in a left-hand direction as viewed in FIG. 4. During movement of the piston 34, the piston moves the piston rod 36, coupling 86, and rod 96 in a left-hand direction.

The cone 102 being secured to the rod 96 is moved in a left-hand direction and, by reason of the tapered regions of the cones 100 and 102, the fingers 44 are moved or expanded outwardly and expand the end region of the tube to an increased diameter, the increased diameter depending upon the position of the selector 74 which limits the movement of the cone 102.

The piston 34 is moved in a left-hand direction until it abuts the stop member 126 in the cylinder 22, this stop member limiting the lengthwise movement of the cone 102. When the piston 34 engages the abutment 126, the cones 100 and 102 have moved the fingers 44 outwardly to the maximum expanded position permitted by the selected position of the selector or locator 74.

When the fingers 44 are moved outwardly or expanded to their outermost position as determined by the selector 74, the end region of the tube engaged by the fingers is expanded to the desired amount.

The operator then moves the control member 60 in a left-hand direction, as viewed in FIG. 1, whereby the valve rod 57 actuates the valve mechanism contained in the housing 18 to a position wherein the oil or fluid from the hydraulic pump 12 is directed through the tube member 53 and end head 28 into the cylinder 22 at the left-hand side of the piston 34.

The fluid pressure builds up on the left side of the piston 84 causing the piston to move in a right-hand direction together with the cone 102. Upon right-hand movement the cone 102, the coil springs 118 and 120 exert inward force against all of the fingers 44 of the group of fingers causing them to collapse to their minimum inward position after which the expanded tube may be slidably removed from the fingers 44.

Whenever the piston 34 completes its movement either in a right-hand direction or a left-hand direction, and the motor is still in operation rotating the hydraulic pump 12, the hydraulic or fluid pressure builds up to actuate the relief valve 69 to permit the fluid in the system to flow through the tube 70 and bypass 71 into the reservoir 54. The operator may cause fluid flow from the pump to be directed through the pipe 68 into the reservoir 54 by simply moving the control member 60 to its mid or neutral position.

From the foregoing it will be seen that the method and apparatus for expanding tubing is usable for expanding tubes of various diameters and to predetermined sizes by positioning the selector or locator 74 with the pins 76 in slots of the proper depth in the barrel 72.

Tubes of varying diameters may be expanded by a selected group of fingers 44 to a desired diameter without the formation of appreciable flat spots adjacent the spaces between fingers of the group. Through the method and arrangement of the invention, end regions of metal tubing may be satisfactorily expanded and the expanded region maintained of circular cylindrical shape and without flat spots.

It is apparent that, within the scope of the invention, modifications and different arrangements may be made other than as herein disclosed, and the present disclosure is illustrative merely, the invention comprehending all variations thereof.

What is claimed is:

1. Apparatus for expanding metal tubing including an assemblage of expandable members, power means for actuating the expandable members including a power-actuated movable shaft, indexing means for determining the amount of outward movement of the expandable members, said indexing means including a relatively stationary element and an adjustable selector element, one of said elements having a plurality of indexing slots of varying depths, the other of said elements having abutment means arranged for cooperation with the indexing slots, a pair of cone-shaped members, one of said cone-shaped members associated with the selector, the other of said cone-shaped members being connected with the power-actuated movable shaft whereby the power-actuated shaft exerts pressure on said cones to effect expansion of the expandable members to expand tubing in engagement with the assemblage of expandable members.

2. Apparatus for expanding metal tubing including an assemblage of expandable fingers, power means for actuating the expandable fingers, said power means including a longitudinally movable shaft, indexing means for determining the amount of outward movement of the expandable fingers, said indexing means including a relatively stationary barrel-shaped element and a selector element slidably adjustable within the barrel-shaped element, said barrel-shaped element having a plurality of slots of different depths, said selector element having abutment means arranged for cooperation with the indexing slots in said barrel-shaped element for positioning the selector element in various positions, a first cone-shaped means associated with the selector element, a second cone-shaped means associated with the shaft, the selected position of the selector element in the barrel-shaped element determining the extent of movement of the second cone-shaped means by the shaft to effect expansion of the expandable fingers to expand tubing in engagement with the expandable fingers.

3. Apparatus for expanding metal tubing including an assemblage of expandable members, power means for actuating the expandable members including a power-actuated longitudinally movable shaft, indexing means for determining the amount of movement of the expandable members, said indexing means including a relatively stationary element and an adjustable selector element, one of said elements having a plurality of indexing recesses of varying depths, the other of said elements having abutment means arranged for cooperation with the indexing recesses, first means associated with the selector element providing a cone-shaped surface, a second means having a cone-shaped surface associated with the power-actuated longitudinally movable shaft, the power-actuated longitudinally movable shaft being arranged to exert pressure on said second cone-shaped means to move said second cone-shaped means toward the first means having a cone-shaped surface to effect expansion of the expandable fingers to expand tubing in engagement with the expandable fingers.

4. Apparatus for expanding metal tubing including an assemblage of expandable fingers, power means for actuating the expandable fingers, said power means comprising a cylinder and piston arrangement and a longitudinally movable member actuated by movements of the piston in the cylinder, end heads for the cylinder, means for supplying fluid under pressure alternately to the end heads for reciprocating the piston in the cylinder, a tubular element secured to one of said end heads and having indexing slots in a wall region thereof, a selector element slidably adjustable in said tubular element and having abutment means selectively cooperable with said slots for positioning the selector element, a first cone-shaped member associated with said selector element, a second cone-shaped member associated with the longitudinally movable member, the power-actuated longitudinally movable member being arranged to exert pressure on said second cone-shaped member upon movement of the piston in one direction to move said second cone-shaped member to effect expansion of the expandable fingers to expand tubing in engagement with the expandable fingers, the movement of the piston in the opposite direction moving the second cone-shaped member to release the expandable fingers from engagement with the expanded tubing.

5. Apparatus for expanding metal tubing including a fluid-actuated motor of the cylinder and piston type, the cylinder being equipped with end heads, means for conveying fluid under pressure alternately to the end heads for effecting reciprocatory movement of the piston, an assemblage of expandable fingers for expanding metal tubing, a shaft extending interiorly of the assemblage of expandable fingers arranged to be actuated by the piston of the motor, a barrel-shaped shaped indexing element mounted in fixed relation with respect to the cylinder of the motor, a selector element slidably adjustable within the barrel-shaped indexing element, a wall of the barrel-shaped element having a plurality of indexing slots of varying depths, abutment means on the selector element for cooperation with the indexing slots, a first cone-shaped member associated with the selector element and having a central opening slidably accommodating the shaft, a second cone-shaped member carried by and movable with the shaft, the fingers of the assemblage having tapered portions engageable with the tapered cone-shaped members, resilient means normally holding the fingers of the assemblage in engagement with the cone-shaped members, at least one of said fingers having an abutment pin for positioning an end region of a tubing in telescoped relation onto the assemblage of fingers, fluid pressure applied to one side of the piston of the fluid-actuated motor moving the shaft whereby the second cone-shaped member is moved toward the first cone-shaped member for expanding the fingers and thereby expanding the tubing, the extent of movement of the second cone-shaped member being determined by the position of the abutment means on the selector element in engagement with a particular slot in the barrel-shaped indexing element and thereby determining the extent of expansion of the tubing.

6. Apparatus according to claim 5 including a pump providing fluid pressure for actuation of the piston, and an electric motor for operating the hydraulic pump.

7. Apparatus according to claim 5 including manually operable valve means for controlling the flow of fluid into and away from the cylinder of the hydraulic motor.

8. Apparatus for expanding metal tubing including an assemblage of expandable fingers, a hydraulically-actuated piston and cylinder type motor, the piston of said motor being adapted to actuate a longitudinally movable shaft, end heads for the cylinder of the motor, means for conveying fluid into and away from the end heads for reciprocating the piston in the cylinder, a barrel-shaped indexing element secured to one of said end heads, a wall region of the barrel-shaped indexing element having a plurality of indexing slots of various depths, a selector slidably and adjustably contained within the barrel-shaped element, said selector having abutment means cooperating with the slots for selectively positioning the selector with respect to the barrel-shaped indexing element, a piston rod connected with the piston of the motor, a coupling member secured to the piston rod, the longitudinally movable shaft being connected with the coupling member, a first cone-shaped member associated with the selector, said first cone-shaped member having a bore accommodating the shaft, the shaft being movable relative to the selector and the first cone-shaped member, a second cone-shaped member arranged to move with the shaft, resilient means engageable with the expandable fingers for urging the fingers into engagement with the first and second cone-shaped members, an abutment means on at least one of the expandable fingers for positioning the end region of a tube to be expanded on the assemblage of fingers, movement of the piston in the cylinder in one direction by fluid pressure moving the second cone-shaped member toward the first cone-shaped member to expand the fingers outwardly to expand the region of tubing in engagement with the fingers, movement of the piston in the opposite direction moving the second cone-shaped member away from the first cone-shaped member to effect an inward collapsing of the fingers from engagement with the expanded portion of the tubing to facilitate removal of the tubing from the assemblage of fingers.

9. The method of expanding tubing including telescoping the tubing onto an assemblage of expandable fingers adapted to be expanded by cone-shaped members, adjusting the relative position of a first cone-shaped member by an adjustable selector for determining the amount to which the tubing is to be expanded, applying power means to a second cone-shaped member, and moving the second cone-shaped member toward the first cone-shaped member by the power means to move the fingers outwardly and expand the tubing.

10. The method of expanding tubing including telescoping a tube onto an assemblage of expandable fingers adapted to be expanded by cone-shaped members, engaging the end of the tubing with an abutment on one of the fingers, adjusting the relative position of a first cone-shaped member by a slidably adjustable selector for determining the amount to which the tubing is to be expanded, applying power from a hydraulic motor to a second cone-shaped member, moving the second cone-shaped member by the hydraulic motor toward the first cone-shaped member whereby the cone-shaped members move the fingers outwardly and expand the tubing, and moving the second cone-shaped member in the opposite direction by the hydraulic motor to release the fingers from the expanded tubing.

* * * * *